US006572363B1

(12) United States Patent
Virgil, Jr. et al.

(10) Patent No.: US 6,572,363 B1
(45) Date of Patent: Jun. 3, 2003

(54) SYSTEM AND METHOD FOR DETECTING FLAME ROLLOUT IN A FURNACE

(75) Inventors: Hall Virgil, Jr., Brownsburg, IN (US); Kevin Thompson, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/871,935

(22) Filed: Jun. 1, 2001

(51) Int. Cl.[7] ..... F23N 5/20; F23N 5/23
(52) U.S. Cl. ..... 431/6; 431/12; 431/70
(58) Field of Search ..... 431/75, 70, 20, 431/31, 6, 12, 69; 237/7; 110/346

(56) References Cited

U.S. PATENT DOCUMENTS 4,337,893 A * 7/1982 Flanders et al. ..... 237/7
4,516,510 A * 5/1985 Basic, Sr. ..... 110/346
4,789,330 A * 12/1988 Ballard et al. ..... 431/75

* cited by examiner

*Primary Examiner*—Henry Bennett
(74) *Attorney, Agent, or Firm*—Wall Marjama & Bilinski LLP

(57) ABSTRACT

A method and system for detecting flame rollout is disclosed. The detection system includes a processor programmed to execute a furnace lockout when the flame proving signal is lost three times after successful burner ignition has been established on each of three heating cycles within a predetermined period of accumulated burner on-time. In one embodiment the period of accumulated burner on-time is 60 minutes. The program executed by the processor resides in firmware. The system and method of present invention mitigates the potentially harmful accumulation of flue gasses when flame sense is lost due to flame rollout.

27 Claims, 3 Drawing Sheets

SYSTEM AND METHOD FOR DETECTING FLAME ROLLOUT IN A FURNACE

BACKGROUND OF THE INVENTION

1. Field of the Invention

The present invention relates generally to furnaces, and particularly to detecting flame rollout in furnaces.

2. Technical Background

Flame rollout is a phenomenon that occurs when a heat exchanger is blocked, the blower compartment is leaking into the heat exchanger, combustion air is deficient, or when flue gas re-circulates into the combustion air stream. When flame roll-out occurs, the flame generated by a gas burner does not emanate inwardly toward the furnace's heat exchanger. Instead, the flame is pulled outwardly into the cabinet of the furnace. Flue gas is recirculated when the flue pipe is somehow removed.

Typically, furnaces include a manual reset temperature actuated flame rollout switch that detects unacceptably high bumer assembly temperatures. It will halt heating operations and will not allow the furnace to resume heating operations until the switch is reset. If a flame rollout condition causes a loss of flame sense before the normally closed manual reset temperature actuated flame rollout switch can open, the furnace will attempt to re-ignite the gas burners to continue heating operations. If repeated flame rollouts of this type occur within a short period of time, an undesirable build up of flue gasses may result.

What is needed is a system for tracking repeated occurrences of loss of flame sense due to flame rollout after successful burner ignition. An ignition is deemed to be a successful ignition if ignition continues to be proved and the gas valve continues to supply the burner with gas for a predetermined amount of time after the ignition of the gas burners. Most of the transient causes of flame loss occur within approximately 70 seconds of elapsed time from the moment of ignition. Thus, when flame sense is lost after 70 seconds of burner operation, it is highly probable that the cause is flame rollout. A method is needed to lockout the furnace after repeated occurrences of lost flame sense due to flame rollout. Lockout would continue for three hours to assure that the undesirable gas build-up dissipates.

SUMMARY OF THE INVENTION

The present invention addresses the above stated problem. The present invention is directed to a system and method for detecting loss of flame sense due to flame rollout in a furnace. The furnace of the present invention includes a flame proving sensor disposed near a gas burner. The flame proving sensor transmits a flame proving signal to a processor when it detects a flame emanating from the gas burner. The present invention tracks repeated incidents of lost flame sense due to flame rollout occurring after successful ignitions of the gas burners. The present invention performs a furnace lockout if three such incidents of flame rollout occur within a predetermined period of time, usually one-hour.

One aspect of the present invention is a method for controlling a furnace. The furnace includes a gas valve, at least one gas burner, and a flame proving sensor. The flame proving sensor is operative to supply the furnace with a flame proving signal when a flame is detected in the at least one gas burner. The method includes performing a furnace lockout when the flame proving signal is lost during each of a predetermined number of heating cycles within a predetermined period of accumulated gas burner on-time. A heating cycle is a period of gas burner flame detection time that is greater than or equal to a first predetermined period of time.

In another aspect, the present invention includes a method for controlling a furnace. The furnace includes a gas valve, at least one gas burner, and a flame proving sensor. The flame proving sensor is operative to supply the furnace with a flame proving signal when a flame is detected in the at least one gas burner. The method includes the steps of actuating the gas valve to an on-state to thereby provide gas to the at least one gas burner. The gas is ignited to thereby produce a flame emanating from the at least one gas burner. The flame proving sensor is checked after the gas valve has been in the on-state for a predetermined amount of time. The gas valve is actuated to an off-state when the flame proving sensor fails to detect a flame in the previous step. The previous steps are repeated twice. Finally, a furnace lockout is performed when all of the previous steps are performed within a second predetermined period of time. The furnace ignores requests for heat during the furnace lockout.

In yet another aspect, the present invention includes a system for detecting flame rollout in a furnace. The furnace includes a gas valve and at least one gas burner. The system includes a flame proving sensor disposed proximate the at least one gas burner, the flame proving sensor being operative to detect a flame emanating from the at least one gas burner. A processor is coupled to the flame proving sensor, the processor being programmed to execute a furnace lockout when the flame proving signal is lost during each of a predetermined number of heating cycles within a predetermined period of accumulated gas burner on-time.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE PREFERRED EMBODIMENTS

Figure 1:
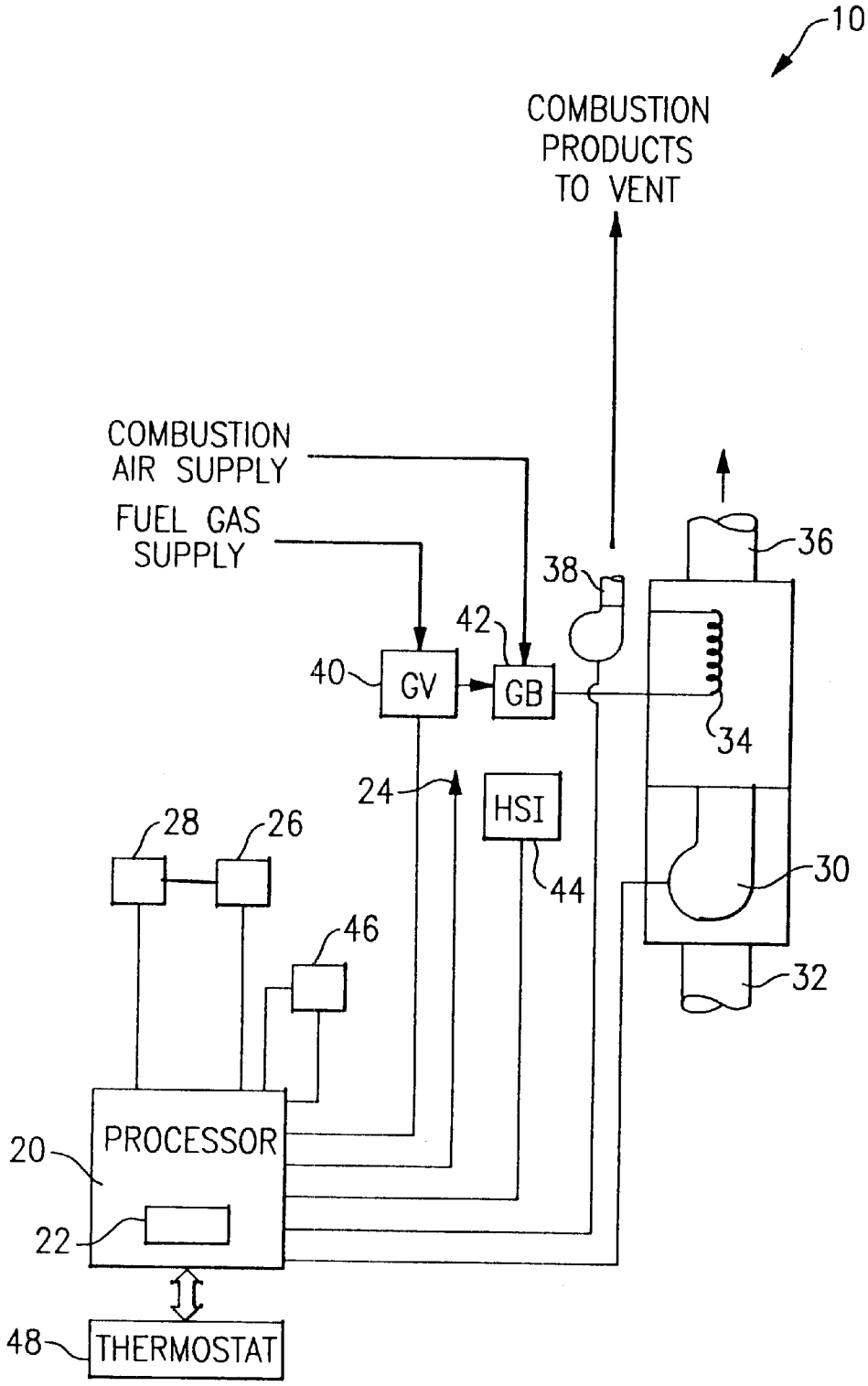
FIG. 1 is a diagrammatic depiction of the flame rollout detection system of the present invention.

Reference will now be made in detail to the present preferred embodiments of the invention, an example of which is illustrated in the accompanying drawings. Wherever possible, the same reference numbers will be used throughout the drawings to refer to the same or like parts. An exemplary embodiment of the flame rollout detection system of the present invention is shown in FIG. 1, and is designated generally throughout by reference numeral 10.

In accordance with the invention, the present invention for a flame rollout detection method includes a processor programmed to execute a furnace lockout when the flame proving signal is lost in each of a predetermined number of heating cycles within a predetermined period of accumulated gas burner on-time, usually one hour. A heating cycle is a period of gas burner flame detection time that is greater than or equal to a predetermined period of time. As discussed above, an ignition is deemed to be successful when ignition continues to be proved and the gas valve continues to supply the at least one gas burner with gas for at least 70 seconds after gas combustion begins in the gas burners. Thus, the predetermined period of time is usually 70 seconds. However, it can be as little as 45 seconds under certain circumstances. The lockout prevents the accumulation of potentially harmful flue gasses. The lockout allows accumulated flue gasses to dissipate.

As embodied herein, and depicted in FIG. 1, a diagrammatic depiction of the flame rollout detection system of the present invention is disclosed. System 10 includes processor 20 which is coupled to memory 22. Processor 20 and memory 22 are located on a furnace control board which also accommodates a transformer (also not shown). The transformer converts high voltage AC power to the low voltage needed by other system components. Processor 20 is also connected to flame proving sensor 24, flame rollout switch 26, limit switch 28, pressure switch 46, gas valve 40, hot surface igniter 44, inducer motor 38, and blower motor 30. Gas valve 40 supplies gas burner 42 with fuel gas. Gas burner 42 is ignited by hot surface igniter 44. The heat generated by burner 42 is used by heat exchanger 34 to heat the air disposed in air supply duct 36. Inducer motor 38 draws the combusted fuel-air mixture through heat exchanger 34 and delivers the cooled mixture to a vent or flue pipe. Blower motor 30 delivers air from the return air plenum 32 to heat exchanger 34, under processor 20 control.

It will be apparent to those of ordinary skill in the pertinent art that processor 20 may be of any suitable type depending on cost or design flexibility considerations. Processor 20 may be implemented using a 4-bit, 8-bit, or one-time programmable processors. Processor 20 includes a timer for measuring the amount of time gas valve 40 is in an on-state, delivering gas to gas burner 42. Processor 20 will also track the cumulative time gas valve 40 is in the on-state. Processor 20 includes another timer for measuring elapsed lockout time.

Figures 2, 2A:
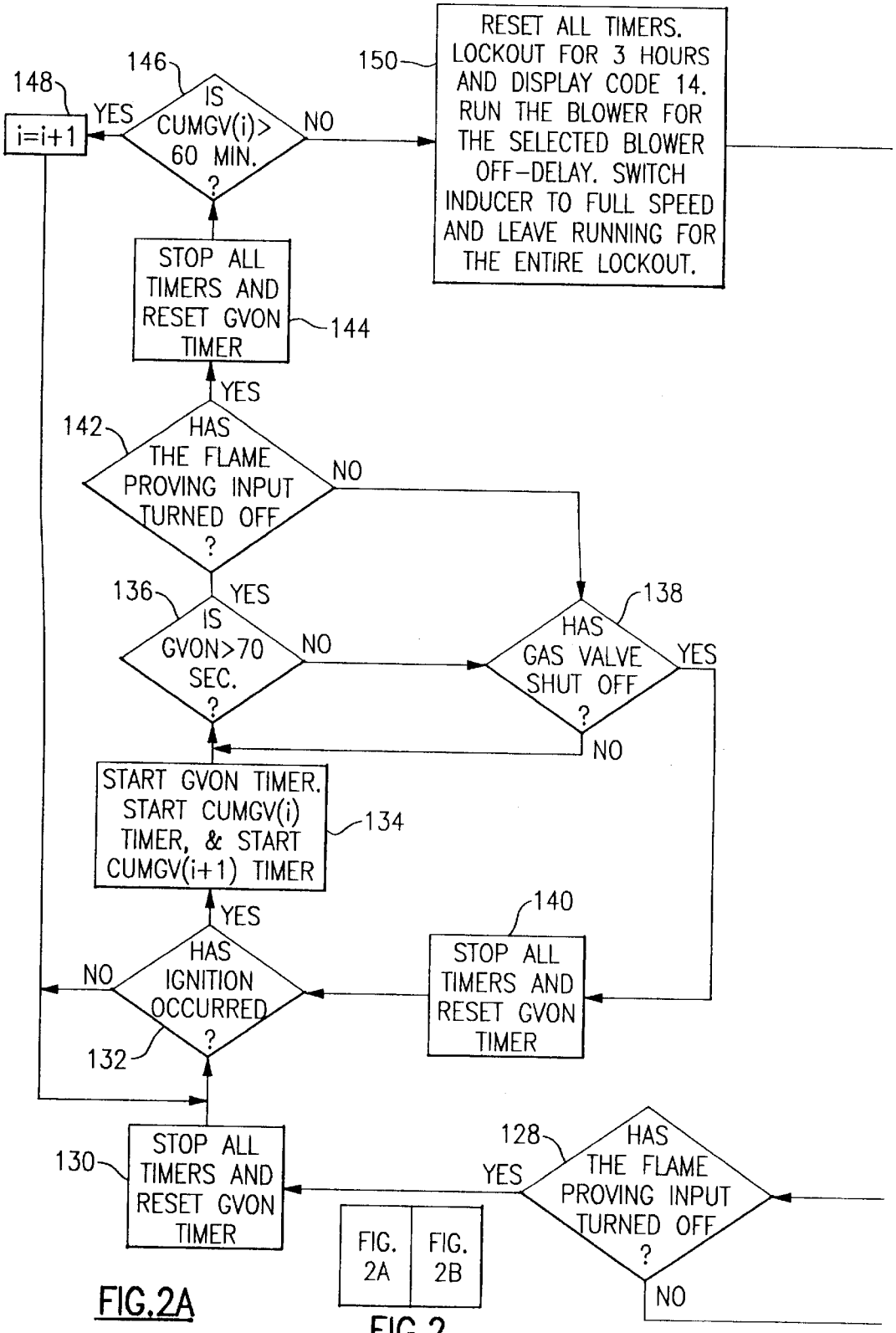
FIGS. 2–2B are flow charts representing the flame rollout detection algorithm of the present invention.
Figure 2B:
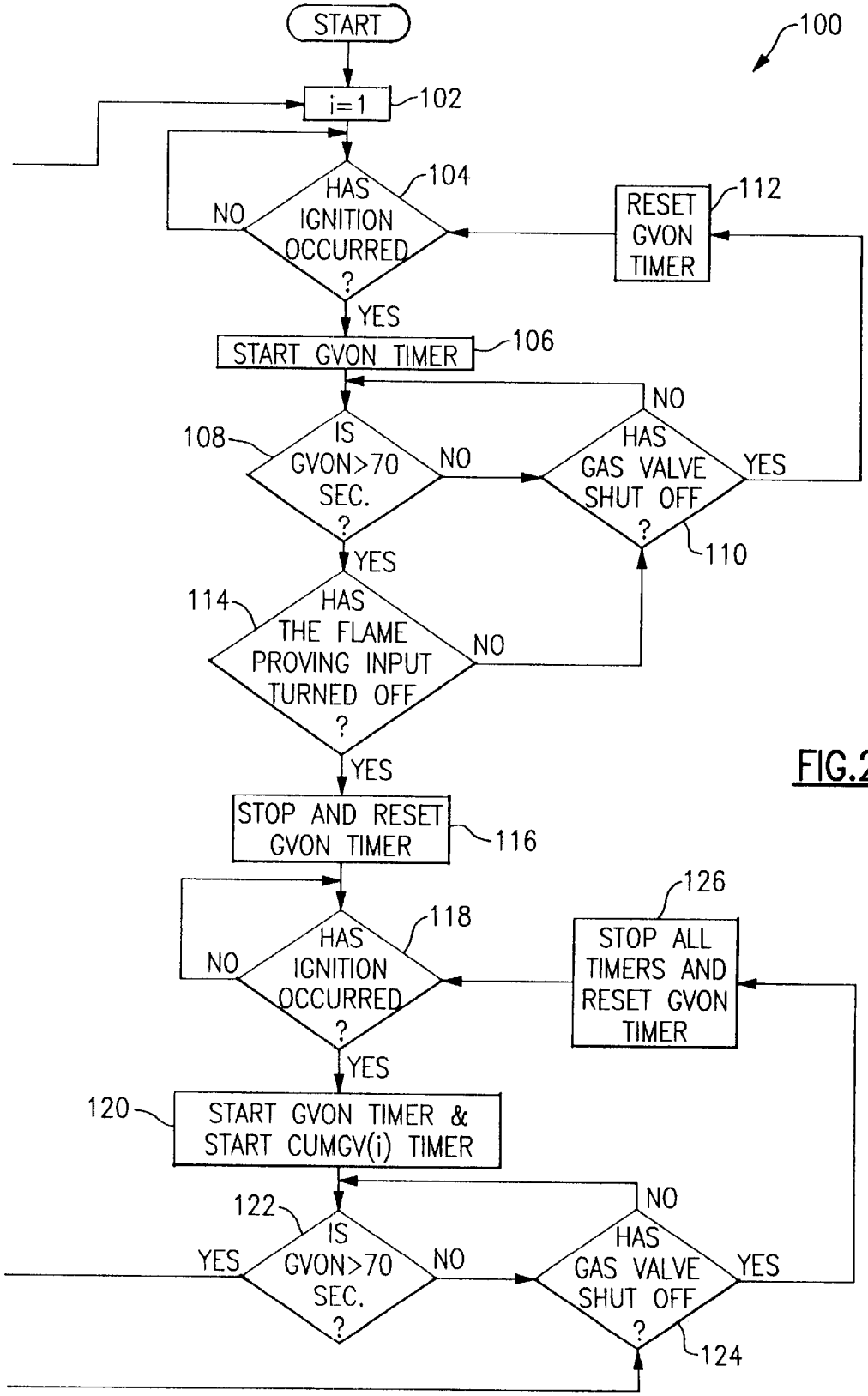

Memory 22 may also be of any suitable type depending on cost or other considerations. The software required to run furnace system 10, including the algorithm depicted in FIG. 2, is resident in memory 22. In one embodiment, memory 22 is resident in processor 20. Other memory structures can also be used.

One skilled in the art will recognize that gas burner 42 includes one or more gas burners.

Under normal operating conditions, system 10 operates as follows. If processor 20 receives a call for heat from thermostat 48, it causes inducer motor 38 to begin drawing air through heat exchanger 34. Pressure switch 46 provides processor 20 with a signal indicating that there is an adequate supply of combustion air for gas burner 42. Combustible fuel gas is delivered to gas burner 42 from gas valve 40. Gas valve 40 includes solenoids that are controlled by processor 20 to provide gas delivery. Subsequently, processor 20 activates hot surface igniter 44 to thereby ignite the air-fuel gas mixture present at gas burner 42. The resultant thermal energy is directed to heat exchanger 34. Heat exchanger 34 transfers the thermal energy to the air disposed in air supply ducts 36. Blower motor draws air from return air plenum 32 and forces it over heat exchanger 34 into the conditioned space. Flame rollout switch 26 detects unacceptably high burner assembly temperatures. Limit switch 28 detects unacceptably hot air passing over heat exchangers 34. Pressure switch 46 detects when an unacceptable amount of combustion air is provided. Processor 20 terminates furnace 10 heating operations in response to these inputs. Finally, flame proving sensor 24 provides processor 20 with a flame detected input in the presence of a flame at gas burner 42.

As discussed above, if the flue pipe is removed, flue gas may contaminate the combustion air stream causing the burners to pulsate. Under these conditions flame rollout conditions may result.

As depicted herein and embodied in FIG. 2, a flow chart representing the flame rollout detection algorithm of the present invention is disclosed. Again, the flame rollout detection algorithm is resident in memory 22 in computer-readable form. In block 102, processor 20 begins the first iteration (i=1) of routine 100. In blocks 104, processor 20 checks flame proving sensor 24 to determine if ignition has occurred. If it has, the timer GVON (gas valve on) is started. If timer GVON indicates that gas valve 40 has been delivering gas to gas burner 42 for at least 70 seconds, processor 20 checks flame proving sensor 24 for the presence of a flame in block 114. If GVON was terminated before 70 seconds elapses, block 108 causes processor 20 to check if gas valve 40 has been shut off. If so, block 112 resets timer GVON and waits for gas burner 42 to re-ignite. In block 114, if GVON indicates that at least 70 seconds had elapsed before the flame proving sensor input was turned off, processor 20 records that a heating cycle was terminated by a loss of flame sense due to a flame rollout condition. GVON is reset in block 116.

Blocks 118, 120, 122, 124, and 126 are almost identical to blocks 104, 106, 108, 110, and 112. The difference is that in block 120, GVON is reset and a cumulative gas valve timer (CUMGV(i)) is started. CUMGV(i) measures the cumulative gas valve on time for the first iteration. The first iteration being measured from the first loss of flame sense due to flame rollout. If GVON indicates in block 128 that at least 70 seconds had elapsed before the flame proving sensor input was turned off, processor 20 records that a second heating cycle was termininated by a loss of flame sense due to a flame rollout condition. In block 130, all of the timers are stopped, and GVON is reset. The process is then repeated a third time.

Blocks 132, 134, 136, 138, and 140 are nearly identical to blocks 104, 106, 108, 110, and 112. The difference is that in block 134, GVON and CUMGV(i) are restarted, and a second iteration timer CUMGV(i+1) is started to measure the cumulative gas valve on time for a second iteration. The second iteration being measured from the second loss of flame sense due to a flame rollout. In block 142, if GVON indicates that at least 70 seconds had elapsed before the flame proving sensor input was turned off, processor 20 records that a third heating cycle was terminated by a loss of flame sense due to a flame rollout condition. In block 144 all of the timers are stopped and GVON is reset.

In block 146, if CUMGV(i) is less than 60 minutes, processor 20 executes a lockout in block 150. All demands for heat from the thermostat will be ignored by processor 20 for three hours. During lockout, blower 30 is run for a predetermined amount of time as determined by the selected blower off-delay. Inducer motor 38 is run at full speed for the entire lockout period.

On the other hand, if CUMGV(i) is greater than or equal to 60 minutes in block 146, processor 20 will not execute a lockout. Instead, processor 20 increments the iteration counter to (i+1) and re-executes blocks 132–146. When block 146 is executed during this econd iteration, processor 20 determines whether CUMGV(i+1) is less than 60 minutes. If so, processor 20 executes a lockout in block 150. Again, all demands for heat from the thermostat will be ignored by processor 20 for three hours. If CUMGV (i+1) is greater than or equal to 60 minutes, iteration (i+2) is commenced, and the processes described herein are repeated.

It will be apparent to those of ordinary skill in the art that variations and modifications can be made to the present invention. For example, in the present invention the heating cycle counts can be greater than or equal to two before implementing furnace lockout. Different timing schemes are used as well. For example, the gas burner on-time GVON can be set at 45 seconds or more. In one embodiment, the gas burner on-time GVON is 66 seconds.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A method for controlling a furnace, the furnace including a gas valve, at least one gas burner, and a flame proving sensor, the flame proving sensor being operative to supply the furnace with a flame proving signal when a flame is detected in the at least one gas burner, the method comprising:

performing a furnace lockout when the flame proving signal is lost during each of a predetermined number of heating cycles within a predetermined period of accumulated gas burner on-time, whereby a heating cycle is a period of gas burner flame detection time that is greater than or equal to a first predetermined period of time.

2. The method of claim 1, wherein the step of performing further comprises:

checking the flame proving sensor when the third period of time has elapsed; and de-energizing the gas valve to thereby terminate the supply of gas to the at least one gas burner when the flame proving signal is lost.

3. The method of claim 2, further comprising:

initializing a timer to measure the third period of time;

checking the gas valve before the third period of time has elapsed; and resetting the timer if it is determined in the step of checking the gas valve that the third period of time did not elapse.

4. The method of claim 1, wherein the furnace does not respond to a request for heat for three hours during the performance of the furnace lockout.

5. The method of claim 1, wherein the predetermined period of accumulated gas burner on-time is greater than or equal to one hour.

6. The method of claim 1, wherein the first predetermined period of time is greater than or equal to 45 seconds.

7. The method of claim 6, wherein the first predetermined period of time is approximately equal to 66 seconds.

8. The method of claim 6, wherein the first predetermined period of time is approximately equal to 70 seconds.

9. The method of claim 1, wherein the predetermined number of heating cycles is three heating cycles.

10. A method for controlling a furnace, the furnace including a gas valve, at least one gas burner, and a flame proving sensor being operative to supply the furnace with a flame proving signal when a flame is detected in the at least one gas burner, the method comprising the steps of:

a.) actuating the gas valve to an on-state to thereby provide gas to the at least one gas burner;

b.) igniting the gas to thereby produce a flame emanating from the at least one gas burner;

c.) checking the flame proving signal after the gas valve has been in the on-state for a first predetermined period of time;

d.) actuating the gas valve to an off-state when the flame proving sensor fails to detect a flame in step c;

e.) repeating steps a, b, c, and d twice; and f.) performing a furnace lockout when steps a, b, c, d, and e are performed within a second predetermined period of accumulated burner on-time, whereby the furnace ignores requests for heat during the furnace lockout.

11. The method of claim 10, wherein step c further comprises the steps of:

g.) determining whether the gas valve has been in the on-state for the first predetermined amount of time; and h.) performing steps c and d if it is determined in step g that the gas valve has not been in the on-state for the first predetermined amount of time.

12. The method of claim 10, wherein the second predetermined period of time is at least one hour.

13. The method of claim 10, further comprising the step of actuating an inducer motor during the furnace lockout, whereby air is provided to dissipate any accumulation of flue gases.

14. The method of claim 10, wherein the furnace lockout is performed for at least three hours.

15. The method of claim 10, wherein the first predetermined period of time is greater than or equal to 45 seconds.

16. The method of claim 15, wherein the first predetermined period of time is approximately equal to 66 seconds.

17. The method of claim 15, wherein the first predetermined period of time is approximately equal to 70 seconds.

18. A system for detecting flame rollout in a furnace, the furnace including a gas valve and at least one gas burner, the system comprising:

a flame proving sensor disposed proximate the at least one gas burner, the flame proving sensor being operative to provide a flame proving signal in response to detecting a flame emanating from the at least one gas burner; and a processor coupled to the flame proving sensor, the processor being programmed to execute a furnace lockout when the flame proving signal is lost in each of a predetermined number of heating cycles within a predetermined period of accumulated gas burner on-time, whereby a heating cycle is a period of gas burner flame detection time that is greater than or equal to a first predetermined period of time.

19. The system of claim 18, further comprising a first timer coupled to the processor, the first timer being adapted to measure an elapsed time of the gas valve being in an on-state, the on-state being a state wherein the gas valve provides gas to the at least one gas burner.

20. The system of claim 19, wherein the first timer measures the predetermined time.

21. The system of claim 18, wherein the predetermined time is substantially equal to one hour.

22. The system of claim 18, wherein the processor performs furnace lockout for approximately three hours.

23. The system of claim 18, wherein the predetermined period of accumulated gas burner on-time is greater than or equal to one hour.

24. The system of claim 18, wherein the first predetermined period of time is greater than or equal to 45 seconds.

25. The system of claim 24, wherein the first predetermined period of time is approximately equal to 66 seconds.

26. The system of claim 24, wherein the first predetermined period of time is approximately equal to 70 seconds.

27. The system of claim 18, wherein the predetermined number of heating cycles is three heating cycles.

* * * * *